United States Patent [19]

Stasiek

[11] Patent Number: 4,497,227

[45] Date of Patent: Feb. 5, 1985

[54] REVERSIBLE RATCHET MECHANISM

[75] Inventor: Jan S. Stasiek, Roswell, Ga.

[73] Assignee: JS Technology, Inc., Atlanta, Ga.

[21] Appl. No.: 461,438

[22] Filed: Jan. 27, 1983

[51] Int. Cl.[3] ..... B25B 13/46

[52] U.S. Cl. ..... 81/63.1; 81/63.2; 192/43.2

[58] Field of Search ..... 81/60–63.2, 81/59.1, 58; 192/43.1, 43.2

[56] References Cited

U.S. PATENT DOCUMENTS

| | | | |
|---|---|---|---|
| 2,395,681 | 2/1946 | Odlum et al. | 192/43.2 |
| 3,677,102 | 7/1972 | Simonetta | 81/63 |
| 4,257,507 | 3/1981 | Solomon | 192/43.1 |
| 4,347,767 | 9/1982 | Gentiluomo | 192/43.1 |

FOREIGN PATENT DOCUMENTS

| | | | |
|---|---|---|---|
| 1340335 | 9/1963 | France | 81/60 |
| 1559093 | 1/1980 | United Kingdom | 81/63.2 |

*Primary Examiner*—James L. Jones, Jr.
*Attorney, Agent, or Firm*—Jones & Askew

[57] ABSTRACT

A ratchet reversing mechanism of the shifting pawl type is operated by a reversing apparatus which is confined to a small arcuate segment of the work-turning member, leaving space over the work-turning member for a quick-release mechanism and for attachment of a speeder ring. A switching ring lies over the pawl and includes a spring-receiving recess which positions a compression spring in a radial plane above the pawl, one end of the spring engaging the pawl and the other end of the spring engaging the switching ring at a location radially outwardly of the engagement with the pawl, such that the spring extends only over the segment of the work-turning member defined by the recess in the work-turning member which receives the pawl. A second pawl is provided in another embodiment of the invention.

11 Claims, 8 Drawing Figures

REVERSIBLE RATCHET MECHANISM

TECHNICAL FIELD

The present invention relates to reversible ratchet mechanisms of the type commonly used in wrenches, and more particularly relates to a reversible ratchet mechanism having a shifting pawl in combination with a quick-release mechanism.

BACKGROUND ART

Typical ratchet mechanisms for wrenches and the like include a housing having a cylindrical bore defining inwardly facing ratchet teeth on the cylindrical surface of the bore, a work-turning member received for rotation within the bore and a rectangular shank on the work-turning member extending outwardly from one side of the housing to engage a socket or the like.

The work-turning member generally carries a pawl within the cylindrical bore and has pawl teeth extending outwardly at appropriate locations on the pawl to enable engagement of the pawl teeth with the ratchet teeth of the housing. A mechanism is provided to move the pawl in order to cause rotation of the work-turning member with the housing in one rotational direction only, the direction of engagement being selectable by the operator.

In many prior reversible ratchet mechanisms, the pawl has been mounted on a pivot shaft, as shown, for example, in U.S. Pat. Nos. 3,393,587; 3,467,231 and 3,532,013. In such mechanisms, the strength of the ratchet wrench depends upon both the strength of the pawl and the strength of the pivot shaft. In order to increase the strength of the pivot shaft, a relatively large bore must be made through the pawl, thereby weakening the strength of the pawl itself. Such ratchet mechanisms are also relatively expensive to make, since the pawl must be provided with two sets of teeth, the pivot shaft must be firmly fixed to the work-turning member, and the work-turning member must be bored and machined to provide a spring mechanism to rotate the pawl about the pivot shaft.

In order to increase the strength of ratchet mechanisms, other prior wrenches have utilized a shifting pawl rather than a rotating pawl. Examples of such mechanisms are shown in U.S. Pat. Nos. 3,369,416; 3,393,780; 3,436,992; 3,306,940 and 3,783,703. In many of these ratchet mechanisms, openings in the pawl itself are minimized or eliminated. Forces exerted by the ratchet housing on the pawl can be compression forces on the pawl, rather than forces transmitted to a pivot shaft. In U.S. Pat. No. 3,306,940, the ratchet action of the pawl is reversed by shifting a coil spring which extends axially down into a large bore in the pawl. This bore weakens the pawl. The spring is caused to move by a shifting plate which is movable above the work-turning member and which is engaged with the work-turning member on the opposite side thereof from the pawl. In U.S. Pat. No. 3,783,703, the pawl is shifted by a wire spring which extends across the top of the work-turning member. At the pawl, the wire spring is inserted into a small bore in the pawl. The spring extends on both sides of a central screw which enters the work-turning member, and also engages a pin extending downwardly from a cap member which, when it is rotated, shifts the end of the spring opposite the pawl and thereby carries the pawl to a new position in response to tension placed on the spring. In practice, the ratchet mechanism shown in the '703 patent is constructed with a rectangular shaped wire spring rather than the heart shaped spring shown in the patent. The corners of the rectangular wire spring are flexed during operation and are subject to failure after repeated use. Also, two chordal recesses must be cut in the work-turning member, one for the pawl and another to permit the spring operating pin to extend vertically downwardly from the cap.

In both U.S. Pat. No. 3,606,940 and No. 3,783,703, almost the entire area above the work-turning member is required for the sweeping motion of either the plate or the wire spring which operates the pawl. In both mechanisms, a central screw holds the operating member to the work-turning member. Recesses, one for the pawl and one for the parts of the operating mechanism, must be cut on opposite sides of the central screw. The area of the work-turning member opposite the pawl is not available for other uses, such as a second pawl, and the unused area at the center of the work-turning member is not large enough to receive a quick-release mechanism.

Examples of quick-release mechanisms are shown in U.S. Pat. Nos. 3,393,587 and 3,532,013. Prior to the introduction of such mechanisms, a spring ball detent was typically provided on the shank of the work-turning member to retain a socket or the like. Removal of the socket from the shank was accomplished by manual pressure overcoming the spring of the ball detent. Quick-release mechanisms utilize a shaft extending through the work-turning member and including a beveled recess which operates the ball. The shaft of the quick-release mechanism is spring loaded into the shank in a manner such that the ball is urged out of the shank to retain the socket. When it is desired to release the socket, the protrusion of the shank through the opposite side of the work turning member is depressed, allowing the ball to move freely into the shank and the socket to move freely off the shank. As will be seen from an examination of the patents noted, a quick-release mechanism requires a significant amount of space at the center of the work-turning member, space which has not previously been available in shifting pawl ratchet mechanisms of the type shown in U.S. Pat. Nos. 3,606,940 and 3,783,703, in which the pawl shifts along a chordal recess in the work-turning member.

SUMMARY OF THE INVENTION

The present invention provides a novel shifting pawl reversible ratchet mechanism in which no parts of the reversing mechanism need engage or sweep over the portion of the work-turning member opposite the pawl. Furthermore, the area required for the reversing mechanism and the pawl leaves a central area large enough to receive a quick release mechanism.

Generally described, a ratchet mechanism according to the present invention includes a housing having a cylindrical bore therethrough defining inwardly facing ratchet teeth on the cylindrical surface of the bore; a work-turning member received for rotation within the bore; and an improved ratchet switching means comprising a pawl defining pawl teeth for engaging the ratchet teeth of the bore, the pawl being positioned for sliding movement along a recess cut into a portion of one end of the work-turning member, a switching member rotatably mounted above the pawl, a spring extending in a radial plane mounted in compression above the pawl, one end of the spring engaging the pawl and the other end of the spring engaging the switching member at a location radially outwardly of the engagement with the pawl such that the spring extends only over the segment of the work-turning member defined by the recess. The operating spring preferably comprises a coil spring of spiral wire, one end of the wire extending axially into a small bore in the pawl and the other end being received in a recess formed in the switching member, which is preferably a ring. The switching ring also preferably defines a pair of axially projecting shoulders spaced on either side of the spring-receiving recess for engaging a wall formed in the work-turning member by the pawl-receiving recess. Such shoulders engage the wall at either end thereof to limit rotational movement of the switching ring.

In the preferred embodiment, the switching ring is positioned within an annular recess in the housing outwardly of the ratchet teeth, and a speeder ring is fixed to the work-turning member through a large central opening in the switching ring. Tabs extend axially from the switching ring through arcuate slots defined in the speeder ring to allow the ratchet mechanism to be reversed. However, the speeder ring can be grasped to turn the work in the "free" direction without having to rotate the entire housing; for example, in finishing the unthreading of a loosened bolt. An additional arcuate slot can be provided in the speeder ring in combination with printed indicia on the face of the switching ring such that switching of the ratchet mechanism alternately exposes indicia indicating to the operator the direction in which the ratchet mechanism is operating.

Since the upper area of the work-turning member is not required for sweeping of a wire spring or plate, sufficient area is available for a quick release mechanism. Also, manufacturing time and expense can be saved because no second recess need be cut into the work-turning member to accommodate necessary parts of the switching mechanism. If desired, however, a second simple chordal recess can be cut opposite the first recess to provide an identical shifting pawl. In one embodiment of the invention, a second pawl is provided with teeth spaced such that the second pawl engages the ratchet teeth of the cylindrical housing out of phase with the first pawl by a rotational distance of one half tooth. The result is a finer ratchet mechanism which incorporates teeth large enough to provide a strong grip between the pawl and the ratchet teeth but which requires a smaller rotational movement of the housing to reengage the pawl for further turning of the work.

When a speeder ring is provided as described above, the free space above the work-turning member allows the speeder ring to be directly attached to the upper surface of the work-turning member by screws which would have interfered with the sweeping movement of the ratchet switching mechanism in prior art devices. The switching mechanism utilizes a coil spring that is always placed in compression during switching, and therefore is not subject to failure like the springs of some prior art devices. Another advantage of the invention over prior ratchet mechanisms is that the travel of the switching ring is limited by abutment with a wall of the chordal recess which holds the pawl, eliminating the need for a separate machining operation for this purpose.

Thus, it is an object of the present invention to provide an improved reversible ratchet mechanism.

It is a further object of the present invention to provide a reversible ratchet mechanism having a shifting pawl operated by a switching mechanism occupying only a small portion of the area over the work-turning member.

It is a further object of the present invention to provide a ratchet mechanism of the shifting pawl type also having a quick-release mechanism.

It is a further object of the present invention to provide a ratchet mechanism having a reliable switching mechanism which does not require weakening of the pawl by the boring of large openings therein or complex machining of the work-turning member to accommodate the ratchet switching mechanism.

Other objects, features and advantages of the present invention will become apparent upon reading the following detailed description of embodiments of the invention with reference to the accompanying drawing.

DETAILED DESCRIPTION

Figure 2:
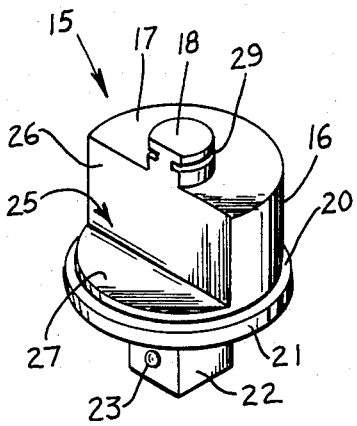
FIG. 2 is a pictorial view of the work-turning member forming a part of the ratchet mechanism shown in FIG. 1.
Figure 1:
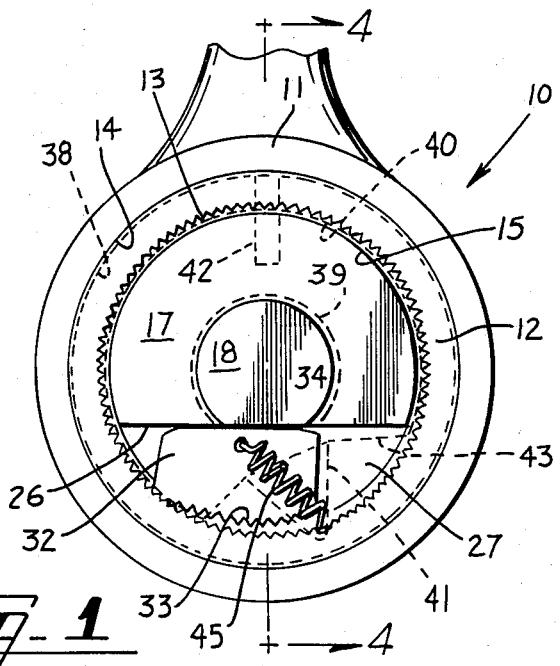
FIG. 1 is a top plan view of a ratchet mechanism embodying the present invention, with the switching ring shown in dotted lines to expose interior detail.
Figure 4:
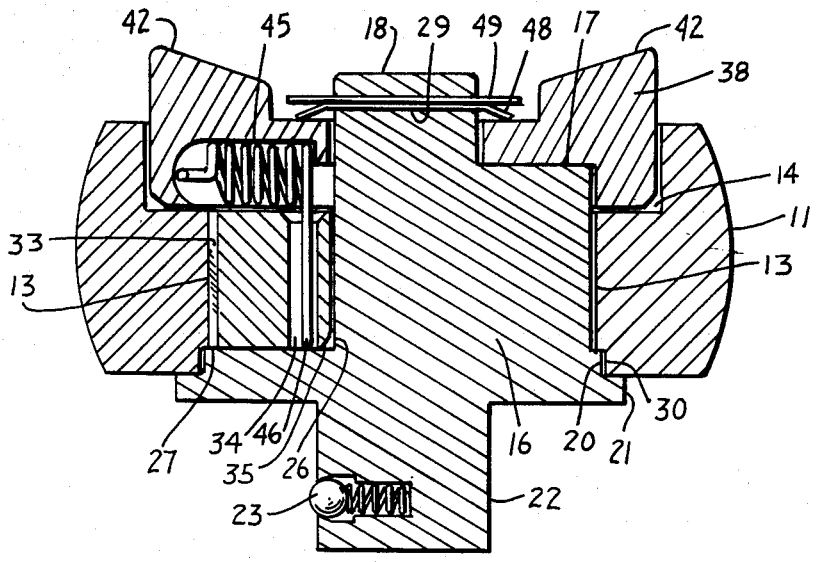
FIG. 4 is a vertical cross-sectional view of the ratchet mechanism shown in FIG. 1, taken along line 4—4.

Referring now in more detail to the drawing, in which like numerals refer to like parts throughout the several views, FIG. 1 shows a ratchet mechanism 10 embodying the invention in top plan view. As shown in FIG. 1 and FIG. 4, the ratchet mechanism 10 includes an annular housing 11 having a cylindrical bore 12 therethrough and ratchet teeth 13 extending inwardly on the cylindrical surface of the bore 12. An annular recess 14 at one end of the housing 11 provides space for receiving parts of the switching mechanism to be described below. A generally cylindrical work-turning member 15 shown alone in FIG. 2, is received within the cylindrical bore 12 of the housing 11. The work-turning member includes a cylindrical body portion 16 having an upper surface 17 from which extends axially a cylindrical post 18. At the end of the body portion 16 opposite the post 18, the diameter of the body portion 16 is enlarged in step wise fashion by a first annular ridge 20 and a second annular ridge 21. When the work-turning member is inserted into the housing 11, the ridge 20 is received within a second annular recess 30 provided in the bottom of the housing 11 as seen in FIG. 4. Opposite the post 18, a rectangular tool-engaging shank 22 receives downwardly from the body portion 16. The shank 22 includes a conventional ball detent 23 for holding a tool, such as a socket (not shown), on the shank 22.

The work-turning member 15 also defines a chordal recess 25 cut out of a portion of the body member 16 and post 18. The recess 25 is defined by a wall 26 which intersects the upper surface 17 and extends in a plane parallel to the axis of the work-turning member 15 (shown in a vertical orientation in FIG. 2) and by a horizontal shelf 27 which extends at right angles to the wall 26 in a radial plane at the level of the first annular ridge 20. The post 18 includes an annular groove 29 for receiving a lock ring as described below.

A pawl 32, best shown in FIG. 1 and FIG. 4, rests upon the shelf 27 within the recess 25 of the work-turning member 15. The pawl 32 is generally rectangular in shape except for its surface facing outwardly toward the ratchet teeth 13 of the housing 11, such surface being curved and defining a plurality of pawl teeth 33. The pawl 32 also defines a vertical bore 34 near the back surface thereof and a beveled rear lower corner 35 to prevent the pawl from jamming in the corner formed between the wall 26 and the shelf 27. The pawl 32 slides along the shelf 27 in response to a switching mechanism to be described. At one end or the other of the shelf 27, the pawl teeth 33 engage the ratchet teeth 13 in a manner to cause the work-turning member to rotate with the housing 11 in one rotational direction and to remain stationary as the housing 11 is rotated in the opposite direction, in a well known manner.

Figure 3:
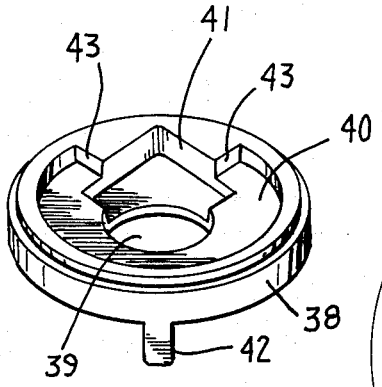
FIG. 3 is a bottom pictorial view of the switching ring shown in dotted lines in FIG. 1.

The ratchet mechanism 10 also includes a switching ring 38, shown in a bottom view in FIG. 3. The switching ring 38 defines at the center thereof of a post-receiving opening 39 which fits over the central post 18 of the work-turning member 15. The switching ring 38 also defines a body-receiving recess 40 which does not extend completely through the ring 38 and fits over the body portion 16 of the work-turning member 15. In one arcuate section of the switching ring 38, the body receiving recess 40 is interrupted by a deeper triangular spring-receiving recess 41. The recess 40 terminates on each side of the spring-receiving recess 41, thereby defining a pair of vertical shoulders 43 which alternately engage the wall 26 to limit rotation of the ring 38 is a manner as described below. On the opposite side of the switching ring 38 a pair of projections or tabs 42 (shown in FIG. 4) extend upwardly to provide a means for manually rotating the switching ring.

When the ratchet mechanism 10 is assembled, a spring 45 comprising a compression spring of coiled wire is received within the recess 41 in the switching ring 38 such that one end of the coiled spring abuts the outwardly extending end of the recess 41. The other end of the spring 45 defines an integrally extending wire post 46 which extends downwardly at right angles to the coil of the spring into the bore 34 in the pawl 32. When assembled, the switching ring 38 fits into the first annular recess 14 in the top of the housing 11. The spring 45 is confined by the recess 41 and by the pawl 32 which lies directly under the spring. The switching ring 38 is held in place by an annular spring clamp 48, shown in FIG. 4, which fits over the post 18 and is held in place by a C-shaped locking ring 49 which snaps into the lock ring groove 29.

In the operation of the embodiment of the invention shown in FIGS. 1–4, the direction of engagement of the ratchet mechanism 10 can be reversed by grasping the tabs 42 and rotating the switching ring 38. It will be seen that the rotation of the switching ring 38 is limited by abutment of the shoulders 43 with the wall 26 of the recess 25 in either rotational direction. Thus, the spring 45 sweeps an arc above the pawl 32 that is within the arcuate section of the work-turning member 15 defined by the ends of the wall 26. In FIG. 1, the pawl has been switched to a position in which the shank can be turned in a clockwise direction by clockwise rotation of the housing 11. The compression spring 45 has been rotated in a counterclockwise direction to a position in which it urges the pawl 32 to the left in FIG. 1 by counterclockwise rotation of the switching ring 38. The bore 34 at which point the spring 45 is attached to the pawl is now slightly more than half the distance to the left along the wall 26. In order to shift the pawl 32 to the right in FIG. 1, and thereby to reverse the ratchet mechanism, the switching ring 38 is rotated in a clockwise direction. The spring 45 moves in an arc until the outward end of the spring is to the left of the bore 34. This causes the compression of the spring to slide the pawl 32 along the shelf 27 until it engages the ratchet teeth 13. Thus, it will be seen that no part of the upper surface 17 of the work-turning member 15 is utilized or swept by parts of the switching mechanism.

Figure 5:
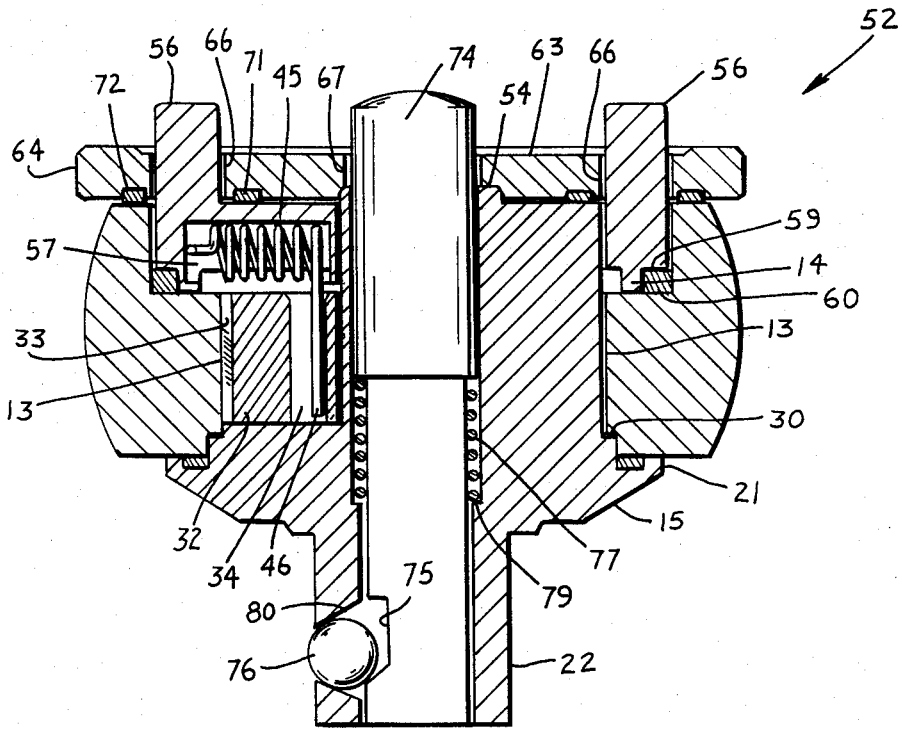
FIG. 5 is a vertical cross-sectional view of a second embodiment of the invention including a speeder ring and a quick-release mechanism.
Figure 6:
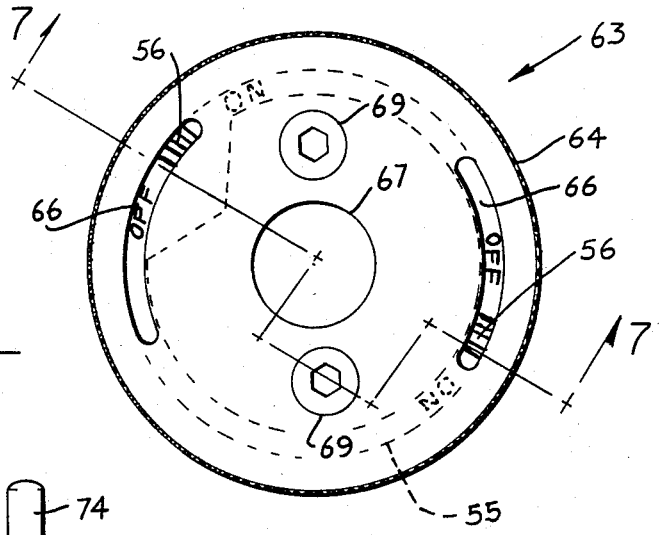
FIG. 6 is a top plan view of the ratchet mechanism of FIG. 5.
Figure 7:
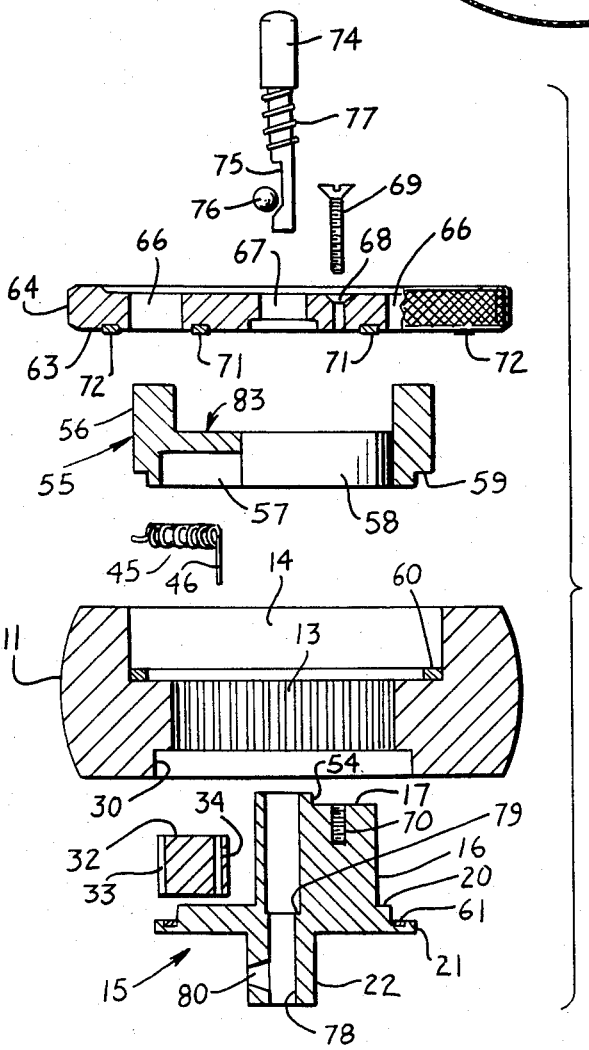
FIG. 7 is an exploded cross-sectional view of the embodiment shown in FIGS. 5 and 6, taken along line 7—7 of FIG. 6.

FIGS. 5–7 show a second embodiment of the invention in a ratchet mechanism 52. As will be seen from the following description of this embodiment, it provides a means for rotating the tool-engaging shank in a direction permitted by the ratchet mechanism without rotating the housing. Also provided is a quick-release mechanism. In many basic respects, the ratchet mechanism 52 is similar to that shown in FIG. 1 and therefore the same reference numerals have been retained for identical parts.

The ratchet mechanism 52 includes a modified switching ring 55, similar to the switching ring 38 of the first embodiment, which defines upwardly projecting tabs 56 for manual operation of the switching ring 55, a large central opening 58 for receiving the body portion 16 of the work-turning member 15 and a spring receiving recess 57 defined by the material of the switching ring 55 integrally extending into a portion of the central opening 58. An annular recess 59 is cut into the bottom periphery of the switching ring 55 for receiving an annular seal 60 that is fitted into the upper annular recess 14 of the housing 11. The seal 60 is formed of a resilient material used for O-rings and the like and serves to prevent contaminating dirt from entering the ratchet mechanism. A second annular seal 61 fits into a groove in the second annular ridge 21 of the work turning member 15 and engages the lower surface of the housing 11 to perform a similar sealing function. The pawl 32 is shifted in a manner similar to that described above.

Unlike the embodiment shown in FIG. 1, the ratchet mechanism 52 includes a speeder ring 63 mounted to the work-turning member 15 and extending outside the housing 11. The speeder ring 53 includes a knurled edge 64, as shown in FIG. 7, so that the ring 63 can be grasped at its periphery and rotated. As shown in FIGS. 6 and 7, the speeder ring 63 defines a pair of arcuate openings 66 therethrough, the grooves 66 receiving the tabs 56 of the switching ring 55. The speeder ring 63 is firmly attached to the upper surface 17 of the work-turning member 15 by a plurality of screws 69 which extend through opening 68 in the speeder ring into tapped holes 70 in the body portion 16 of the work-turning member 15. It should be noted that it is possible to utilize the screws 69 for such attachment because the switching mechanism parts, such as the spring 45, do not require the space over the upper surface 17 for their operation. When assembled, the speeder ring 63 also engages the outer periphery of the upper surface of the housing 11. An inner annular seal 71 provides a seal between the speeder ring 63 and the work-turning member 15, to which it is attached, inside the arcuate slots 66. An outer annular seal 72 is also provided for slidable engagement with the upper surface of the housing 11.

A central opening 67 is also provided in the speeder ring 63, and the opening 67 permits a quick release shaft 74 to be inserted through the speeder ring 63 and into a central bore 78 through a central post 54 of the work-turning member 15 and through the remainder of the body portion 16 and shank 22. A recess 75 formed in the shaft 74 operates a ball 76 in a well known manner to urge the ball out of a radial opening 80 in the shank 22 when the shaft 74 is in a raised position, and to allow the ball 76 to retract into the shank 22 when the shaft 74 is depressed downwardly. A compression coil spring 77 resting on an annular shelf 79 formed in the central bore 78 is compressed when the shaft 74 is depressed, and normally urges the shaft 74 into its upper position, shown in FIG. 5.

A top view of the speeder ring 63 is shown in FIG. 6. A pair of indicia 83 are placed on the switching ring 55 by printing, engraving or the like. As the switching ring 55 rotates about the body portion 16 of the work-turning member 15, the indicia alternately enter one of the slots 16 and can be viewed by the operator. As shown, the indicia 83 are the words "OFF" which is exposed when the tabs 56 are in the position shown in FIG. 6, and the word "ON" which is hidden in the position shown in FIG. 6, and therefore is shown in phantom lines. Other alternate indicia may be used, such as arrows giving a direction in which movement of the housing 11 will also move the work-turning member 15.

Operation of the ratchet mechanism 52 will be apparent from the above description of its construction and the previous description of the first embodiment of the invention. The ratchet mechanism is reversed by manually rotating the switching ring 55 utilizing the tabs 56 which extend upwardly through the speeder ring 64. The indicia 83 will indicate the mode of operation of the ratchet mechanism. If it is desired to quickly rotate the work-turning member 15 in the direction freely permitted by the ratchet mechanism, the speeder ring 63 can be grasped by its knurled peripheral edge 64 and rotated. Since the work-turning member 15 extends through the housing 11 and the switching ring 55, the rotation of the speeder ring 63 will turn the work-turning member 15 in the appropriate direction without turning the housing 11 or switching the position of the switching ring 55. During this operation the ratchet 32 will move with the work-turning member 15 and jog past the ratchet teeth 13 of the housing 11 against the pressure of the spring 45. The operation of the speeder ring 63 is a particular convenience when it is desired to run a screw or bolt in or out of a tapped hole prior to the final tightening or after initial loosening of the screw or bolt.

Operation of the quick release mechanism is done in a conventional manner simply by depressing the extending end of the quick release shaft 74. The applicant's invention makes it possible to include in a single ratchet mechanism a shifting pawl type reversing apparatus, a conventional quick release mechanism, and a speeder ring attached to the upper surface of the work-turning member. The combination of features is made possible by the fact that the ratchet reversing mechanism requires relatively little of the space above the work-turning member for its operation.

Figure 8:
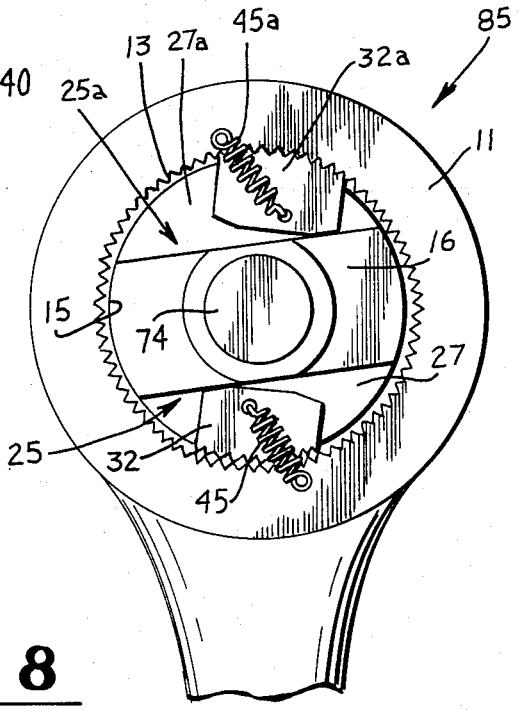
FIG. 8 is a top plan view of a third embodiment of the invention having two pawls, the switching ring being removed to show interior detail.

Another advantage of the space-saving ratchet reversing mechanism of the present invention can be seen in the third embodiment 85 of the invention shown in FIG. 8. In this diagramatic representation of the ratchet mechanism 85, it will be seen that space is available for the cutting of a second chordal recess **25*a* opposite the initial recess 25, and for a second pawl 32*a* slidably movable along a second shelf 27*a*. The switching ring (not shown) includes dual spring receiving recesses for operation of the springs 45 and 45*a*. Since the operation of such springs is confined over the chordal recesses 25 and 25*a*, there is still sufficient space at the center of the work-turning member 15 to provide a quick-release shaft 74**.

Another feature of the present invention can be provided in the ratchet mechanism 85 by sizing the pawls 32 and **32*a* and positioning their teeth so that they do not engage the ratchet teeth 13 of the housing 11 simultaneously. This results in a finer ratchet action since the housing 11 can be movable for a shorter rotational distance before engaging one of the pawls. This is preferable to decreasing the size of the ratchet teeth on the housing and the pawls, which would reduce the strength of the mechanism by increasing the likelihood that the teeth would slip by one another. If fine ratchet operation is not desired or needed, the pawls can be constructed to simultaneously engage the ratchet teeth of the housing 11 to provide double the strength of engagement between the work-turning member 15 and the housing 11**.

It will thus be seen that the present invention provides significant advantages in a ratchet mechanism over prior devices. A ratchet mechanism according to the invention is simple to manufacture because only simple machining operations are required. The same simple chordal cut in the work-turning member to receive the pawl also provides abutments for limiting the rotational travel of the ratchet switching mechanism, eliminating the need for an additional recess cut into the work-turning member for this purpose. Furthermore, the space-saving ratchet reversing apparatus permits the combination of several desirable ratchet wrench features along with the highly desirable shifting pawl type apparatus, by elimination of the need for operating parts which sweep across large areas of the space above the work-turning member.

While this invention has been described in detail with particular reference to preferred embodiments thereof, it will be understood that variations and modifications can be made without departing from the spirit and scope of the invention as defined in the appended claims.

What is claimed is:

1. In a ratchet mechanism including a housing having a cylindrical bore therethrough defining inwardly facing ratchet teeth on the cylindrical surface of said bore and a work-turning member received for rotation within said bore, an improved ratchet switching means comprising:

a pawl defining pawl teeth for engaging said ratchet teeth of said bore, said pawl being positioned for sliding movement along a recess cut into a portion of one end of said work-turning member;

a switching member rotatably mounted outwardly of said pawl; and a spring extending in a radial plane mounted in compression above said pawl, one end of said spring engaging said pawl and the other end of said spring engaging said switching member at a location radially outwardly of said engagement with said pawl such that said spring extends only over the segment of said work-turning member defined by said recess in all positions of said pawl.

2. The apparatus of claim 1, further comprising quick-release means extending axially through said work-turning member.

3. The apparatus of claim 1, wherein said switching member comprises a ring positioned within an annular recess defined in said housing outwardly of said ratchet teeth, and further comprising speeder ring means positioned above said switching ring and rigidly fixed directly to the upper surface of said work-turning member along a path of contact beginning at one end of said pawl-receiving recess and extending continuously around the periphery of said work-turning member to the other end of said pawl-receiving recess, for rotating said work-turning member independently of the operation of said switching ring, said speeder ring means including a peripheral gripping surface; and said switching ring including at least one tab extending axially through an arcuate slot defined in said speeder ring means.

4. The apparatus of claim 3, wherein said speeder ring means further includes an additional arcuate slot alternately exposing indicia on said switching ring indicating respectively the positions of said pawl.

5. In a ratchet mechanism including a housing having a cylindrical bore therethrough defining inwardly facing ratchet teeth on the cylindrical surface of said bore and a work-turning member received for rotation within said bore, an improved ratchet switching means comprising:

a pawl defining pawl teeth for engaging said ratchet teeth of said bore, said pawl being positioned for sliding movement along a recess cut into a portion of one end of said work-turning member;

a switching ring rotatably mounted outwardly of said pawl;

a spring extending in a radial plane mounted in compression above said pawl, one end of said spring engaging said pawl and the other end of said spring engaging said switching ring at a location radially outwardly of said engagement with said pawl such that said spring extends only over the segment of said work-turning member defined by said recess; and speeder ring means, positioned above said switching ring and rigidly fixed directly to the upper surface of said work-turning member through an opening defined in said switching ring, for rotating said work-turning member independently of the operation of said switching ring.

6. The apparatus of claim 5, further comprising a second pawl positioned in a second recess in said work-turning member opposite said first pawl-receiving recess; and a second spring operatively engaging said second pawl and said switching ring.

7. The apparatus of claim 6, wherein said second pawl is positioned to engage said ratchet teeth at an offset of one-half tooth with respect to said first pawl, said pawls being simultaneously operated by said switching ring.

8. The apparatus of claim 3, wherein said path of contact extends more than half the distance around the periphery of said work-turning member.

9. In a ratchet mechanism including a housing having a cylindrical bore therethrough defining inwardly facing ratchet teeth on the cylindrical surface of said bore and a work-turning member received for rotation within said bore, an improved ratchet switching means comprising:

a pawl defining pawl teeth for engaging said ratchet teeth of said bore, said pawl being positioned for sliding movement along a recess cut into a portion of one end of said work-turning member;

a switching member rotatably mounted outwardly of said pawl; and a spring extending in a radial plane mounted in compression above said pawl, one end of said spring engaging said pawl and the other end of said spring engaging said switching member at a location radially outwardly of said engagement with said pawl such that said spring extends only over the segment of aid work-turning member defined by said recess;

said spring comprising a coil spring of spiral wire, one end of said coil spring engaging said pawl and the other end being received in a recess formed in said switching member.

10. The apparatus of claim 9, wherein one end of the wire of said coil spring extends axially into a bore in said pawl and the other end of said wire is received in said recess.

11. The apparatus of claim 9, wherein said switching member includes a pair of axially projecting shoulders spaced on either side of said spring-receiving recess for engaging a wall formed in said work-turning member by said pawl-receiving recess to limit rotational movement of said switching ring.

* * * * *